US006478625B2

(12) United States Patent
Tolmie et al.

(10) Patent No.: US 6,478,625 B2
(45) Date of Patent: Nov. 12, 2002

(54) ELECTRICAL-OPTICAL HYBRID CONNECTOR

(76) Inventors: Bernard R. Tolmie, 204 Brand Farm Dr., So. Burlington, VT (US) 05403; Robert H. Wittemeyer, 118 James Ave., Burlington, VT (US) 05401

( * ) Notice: Subject to any disclaimer, the term of this patent is extended or adjusted under 35 U.S.C. 154(b) by 0 days.

(21) Appl. No.: 09/899,394

(22) Filed: Jul. 5, 2001

(65) Prior Publication Data

US 2002/0006748 A1 Jan. 17, 2002

Related U.S. Application Data

(63) Continuation-in-part of application No. 09/614,171, filed on Jul. 11, 2000, now Pat. No. 6,238,792.

(51) Int. Cl.[7] ..... H01R 13/648
(52) U.S. Cl. ..... 439/608; 439/577; 385/75
(58) Field of Search ..... 439/608, 108, 439/701; 385/75, 101

(56) References Cited

U.S. PATENT DOCUMENTS

| | | | | | |
|---|---|---|---|---|---|
| 3,790,654 | A | | 2/1974 | Bagley | 264/177 |
| 4,985,000 | A | * | 1/1991 | Tengler et al. | 439/497 |
| 5,104,243 | A | * | 4/1992 | Harding | 385/84 |
| 5,162,001 | A | * | 11/1992 | Harwath et al. | 439/608 |
| 5,175,928 | A | * | 1/1993 | Grabbe | 29/884 |
| 5,242,315 | A | * | 9/1993 | O'Dea | 439/577 |
| 5,345,527 | A | * | 9/1994 | Lebby et al. | 385/114 |
| 5,367,593 | A | * | 11/1994 | Lebby et al. | 385/53 |
| 5,625,734 | A | * | 4/1997 | Thomas et al. | 385/88 |
| 5,664,968 | A | * | 9/1997 | Mickievicz | 439/608 |
| 5,745,622 | A | * | 4/1998 | Birnbaum et al. | 385/75 |
| 5,768,456 | A | * | 6/1998 | Knapp et al. | 385/49 |
| 5,924,899 | A | * | 7/1999 | Paagman | 439/701 |
| 6,179,663 | B1 | * | 1/2001 | Bradley et al. | 439/608 |
| 6,217,372 | B1 | * | 4/2001 | Reed | 439/497 |
| 6,243,508 | B1 | * | 6/2001 | Jewell et al. | 385/14 |
| 2001/0026388 | A1 | * | 10/2001 | Zanten et al. | 359/163 |

* cited by examiner

*Primary Examiner*—Brian Sircus
*Assistant Examiner*—Hae Moon Hyeon

(57) ABSTRACT

This invention relates generally to an extruded metal rectangular electrical connector housing making a novel electrical connector module configuration having a plurality of contacts. The rectangular connector has a plurality of contacts, with each contact being enclosed in a metal shield along the contact length. The assembly has a rectangular metallic housing that contains a plurality of contact channels through which the contacts are inserted. The contacts are insulated by a coating positioned on the inside of the housing. The contacts are connected to an intermediate printed circuit board. The housing assemblies are stackable because of their shape. The invention also includes a hybrid electrical-optical connector that employs VCSEL technology, so that both electrical and optical connections can be accommodated in the same connector.

14 Claims, 8 Drawing Sheets

ELECTRICAL-OPTICAL HYBRID CONNECTOR

RELATED APPLICATION AND CROSS-REFERENCE

This application is a continuation-in-part of U.S. Pat. No. 6,238,792, entitled "Extruded metallic electrical connector assembly and method of producing same," formerly U.S. patent application Ser. No. 09/614,171 filed Jul. 11, 2000.

FIELD OF THE INVENTION

The present invention pertains to electrical connectors, and in particular, to an extruded metallic electrical connector assembly that allows for the connection of optical fibers and/or electrical wires.

BACKGROUND OF THE INVENTION

Electrical connectors are used in many different types of electrical and electronic systems. They come in various sizes depending on the physical and electrical parameter of the installation. Some high-speed digital signal applications require multiple contact connectors in a single rectangular module that are held together and stackable without distorting or adversely modifying the signal intelligence. Digital signals must have a high degree of signal integrity on entering and exiting an electrical connector system. Requirements for connector types, in increasingly high-speed applications include a high degree of shielding, preventing signal distortion from outside Electromagnetic Interference (EMI) and low inductance and resistance for signal and return signal paths.

Rectangular connectors with multiple contacts that are two millimeter (2 mm) or less in center spacing have limits in contact density and signal shielding by currently employed manufacturing processes. However, electronic systems that use high-speed connectors continue to shrink in physical size and require increasing signal density reducing physical size requirements for connectors. Current rectangular connectors having a plurality of contacts have limits in providing dense signal packaging and shielding of each individual contact within the connector-housing module.

Although classical round coaxial connectors contiguous shielding, along the contact length and provide low inductance and good signal integrity, they do not offer the plurality of contacts, particularly for densities of 2 mm or less in a rectangular configuration. In round coaxial connections, multiple contiguous contacts cannot be densely packed or stacked in a module form to densities attainable in a rectangular configuration. Connectors of a rectangular shape, having a plurality of contacts 2 mm or less for high-speed signal application, use a combination of injection molded plastics either riveted or press fitted to metal plates to simulate shielding and reduce inductance and resistance to improve signal integrity. However, these connector systems, while providing greater contact densities than round coaxial connectors, do not provide a contiguous metal cavity along the length of each individual contact. Instead only one or two sides of each individual contact has a shield vs. all 4 sides of the extruded connector-housing module described here.

Presently, most high-density connectors are either electrical or optical. Some fiber optic interfaces occur at the printed circuit board level and convert the electrical signal to light (optical) signals through devices such as a vertical cavity surface emitting lasers (VCSELs), whereby the electrical high speed signal is converted into high-speed modulated light signal. However, there is a need for a truly cost-effective and easy to manufacture hybrid electrical-optical connector.

SUMMARY OF THE INVENTION

The present invention pertains to electrical connectors, and in particular, to an extruded metallic electrical connector assembly that allows for the connection of optical fibers and/or electrical wires.

DETAILED DESCRIPTION OF THE INVENTION

The present invention pertains to electrical connectors, and in particular, to an extruded metallic electrical connector assembly that allows for the connection of optical fibers and/or electrical wires. The present invention is related to U.S. Pat. No. 6,238,792, entitled "Extruded metallic electrical connector assembly and method of producing same," formerly U.S. patent application Ser. No. 09/614,171, which patent is incorporated by reference herein.

As shown in the Figures, the extruded metallic electrical connector assembly 10 provides a four-sided metal enclosure along the contact's length of individual contacts for high-density low inductance, resistance and good signal integrity. This means and method of shielding each individual contact along the contacts length by the connector housing 11 contiguously extruded from metal to form individual channels 12, 12*a*, 12*b*, 12*c* and 12*d* to house each contact providing multiple cavities. In an example embodiment, the contacts are on centers of 2 mm or less. The interior of the channels are insulated from an inserted electrical contact by coating the interior of each channel wall with an insulation material having good dielectric properties for the signal transmission and contact insulation.

Figure 1:
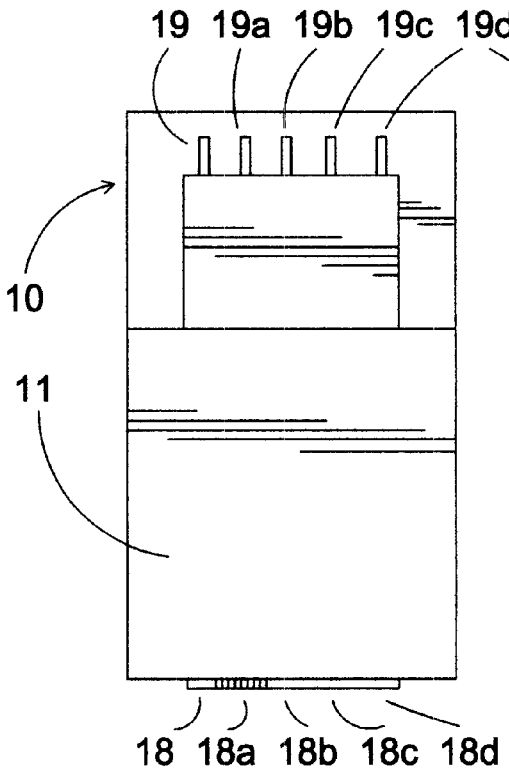
FIG. 1 is a top plan view of the novel extruded metallic connector assembly connected to an electrical cable.
Figure 2:
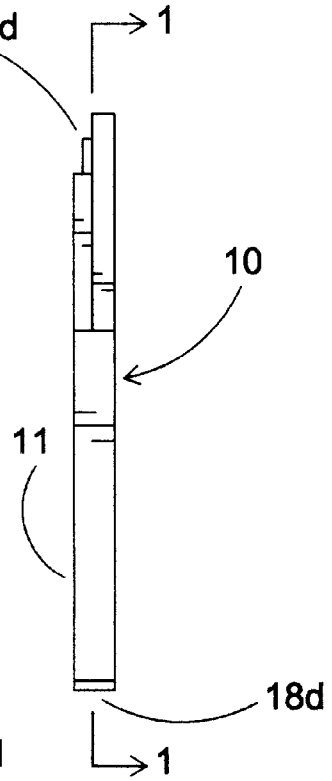
FIG. 2 is a side elevational view thereof.
Figure 3:
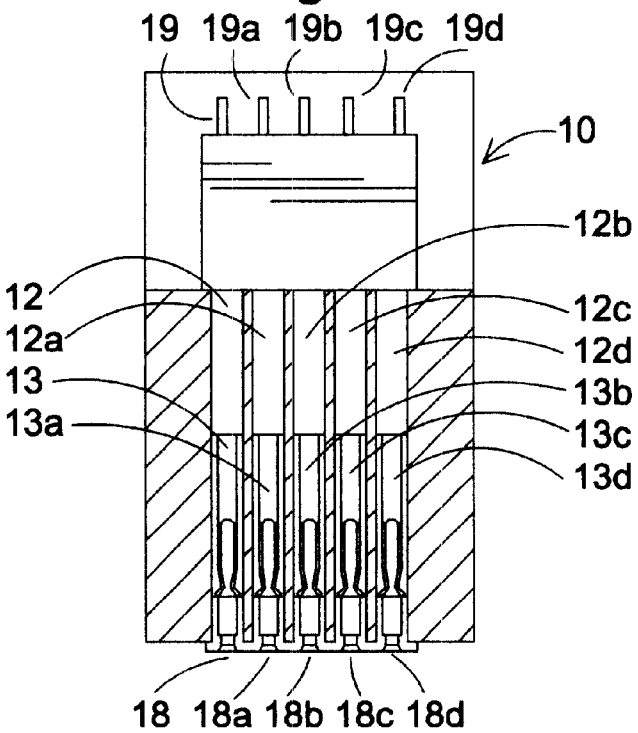
FIG. 3 is a cross sectional view taken along line 1—1 of FIG. 2.
Figure 4:
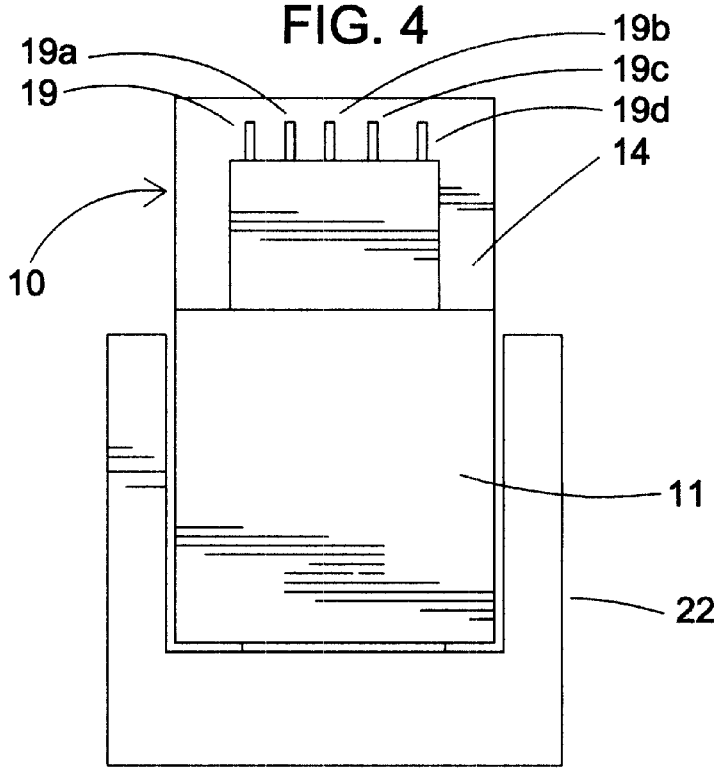
FIG. 4 is a frontal elevational view of connector assembly for mounting to an electrical cable.
Figure 6:
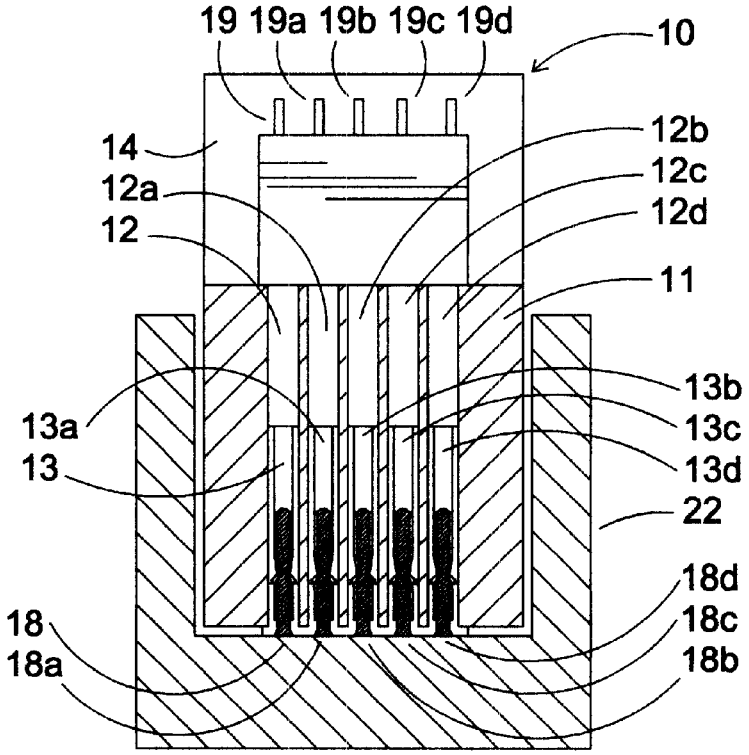
FIG. 6 is a cross-sectional view taken along line 6—6 of FIG. 5 showing the underside mounted to a mating connector receptacle.
Figure 5:
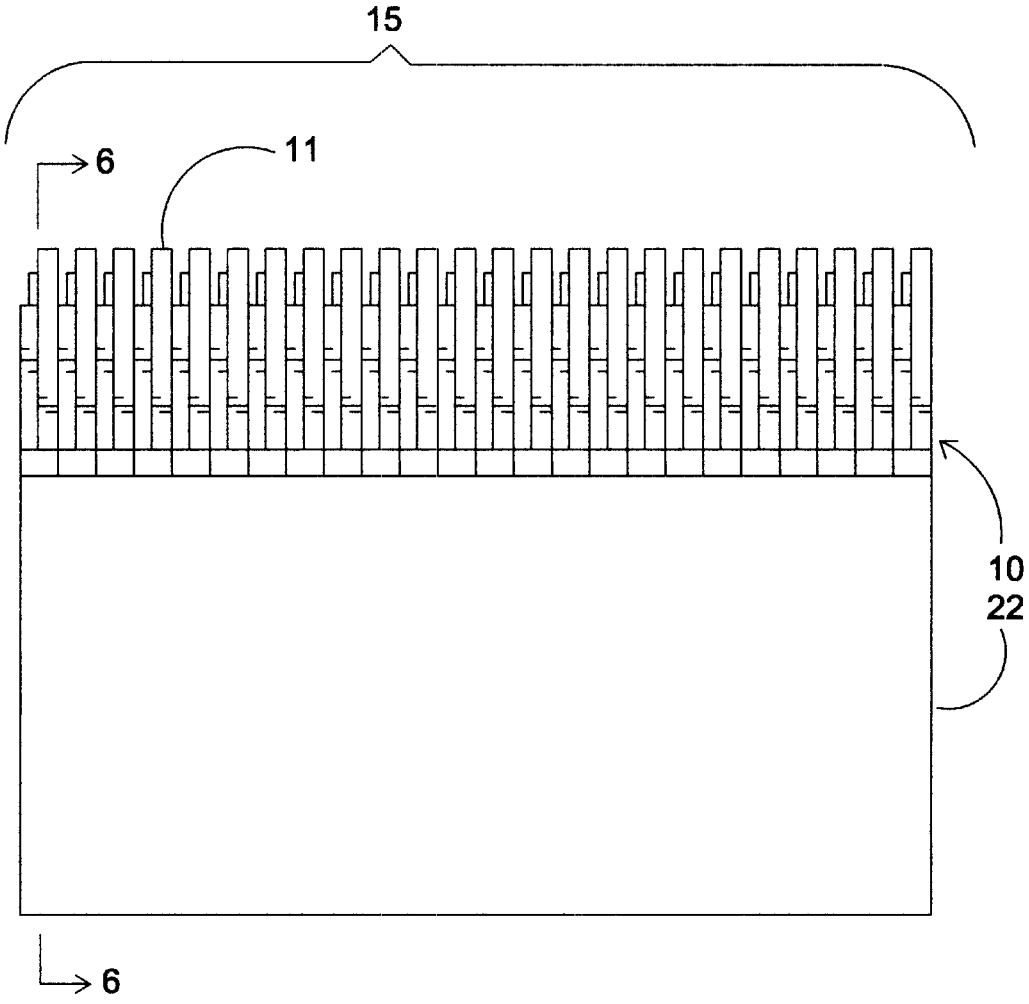
FIG. 5 is a side elevational view of the stacked and mated view of connector assemblies for mounting to an electrical cable.
Figure 7:
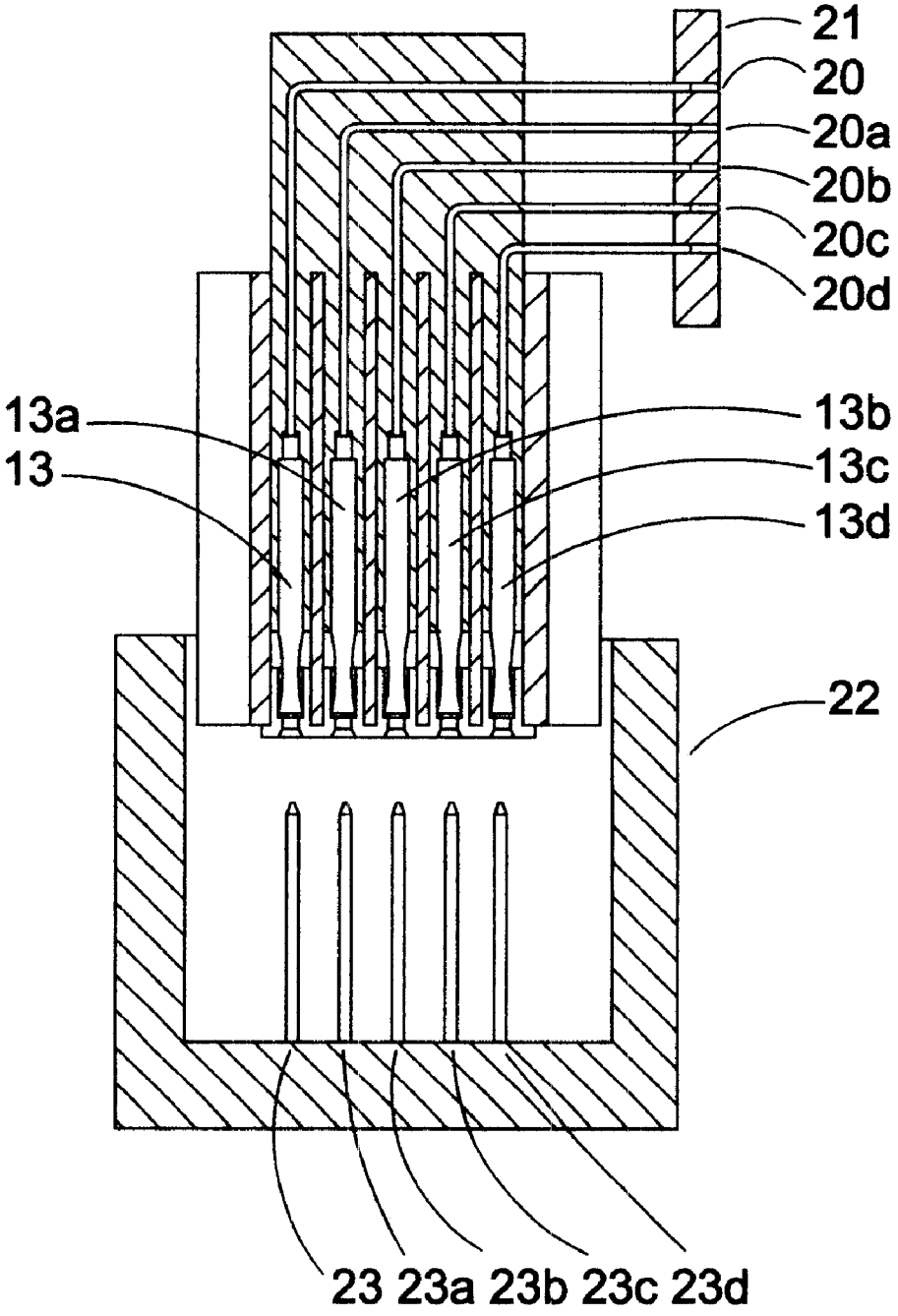
FIG. 7 is a cross sectional view showing the underside mounted to a motherboard.
Figure 9:
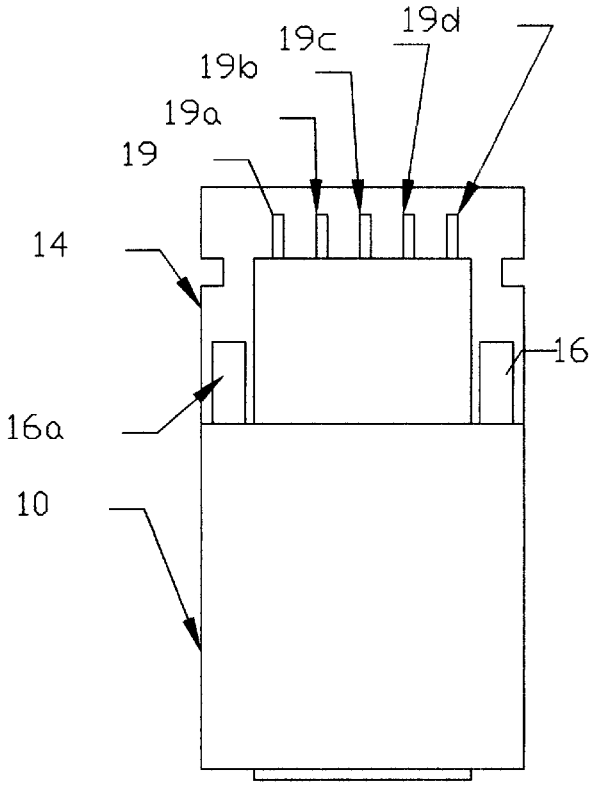
FIG. 9 is a top plan view of FIG. 8, showing the connector assembly for mounting to an electrical cable.
Figure 8:
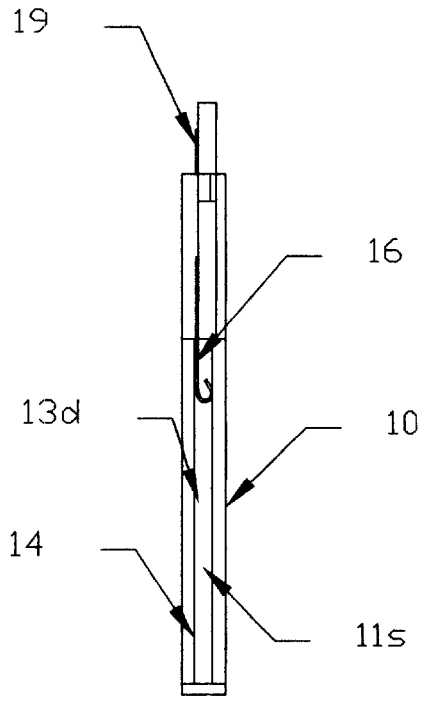
FIG. 8 is a side view of the connector assembly showing the ground contact tension points.

Contact pins 13–13*d* are inserted into channels 12–12*d* (also referred to herein as "cavities"), guided by mating guides 18–18*d*. The latter are positioned at the mating end of housing 11 (opposite the end where IPCB 14 is connected) and are inserted into the housing by a press-fit or an adhesive (see FIGS. 1 and 3). Intermediate printed circuit board 14 includes solder tails 19, 19*a*, 19*b*, 19*c* and 19*d* or a board press-fit 20*a*, 20*b*, 20*c* and 20*d* that allow a cable or another printed circuit board to be attached to circuit board 14 (FIG. 7). The pin can then be directly mounted to a intermediate printed circuit (IPCB) board 14 making up part of the connector assembly 10 for termination to an electrical cable assembly or printed circuit board (motherboard) 21. The IPCB 14 can have circuit board traces that route signals through solder tails 19, 19*a*, 19*b*, 19*c* and 19*d* to the connector contacts in the housing module.

The connector can also be mounted directly to a stand-alone electronic printed circuit board or motherboard 21 without an IPCB 14. The other half 22 of the connector accepts the extruded housing 11 in a single or stackable modular configuration 15 having the same center spacing of two mm or less. Each half of the mating connector has a contact pin 13 through 13*d* and 22 through 22*d*. The contact pins of each half make contact in a cantilever fashion (displacing each pin along its length thus making electrical contact). The contact of the mating connector pins is made inside the extruded connector-housing module 11. Thus, the enclosed mating contact pins are inside the connector-housing cavity providing a four-sided metal enclosure along the length of the mating pins. Traditionally, connector housings are often injection molded from plastics and fit with a metal shield or metal stiffeners in an attempt to achieve a partially shielded enclosure.

The extruded housing 11, however, provides a four-sided metal enclosure for each contact along the length of the contact. Housing 11 (also referred to herein as "contiguous metal shield") is grounded through the intermediate printed circuit board 14 using contact tension points 16 and 16*a*. In this manner, shielded contact density is higher in the extruded module for each individual contacts then the previous patents.

For example, in the prior art housing modules, the signal density is limited by the spacing to the adjacent contact, which is surrounded by an injection-molded material in the multiple connector modules. The prior art makes some adjustment for the shield limitation by optionally grounding adjacent pins (e.g., pins 13 through 13*d* in the present invention) between the signal pins. In this manner, each signal pin may have an adjacent ground pin. In addition, certain prior art has one outside face on two sides of each module shielded by attaching a metal plate, versus the four sides of the present invention. The insulation between contacts in the prior art is typically injection-molded material. Thus, the signal or ground pins do not have a contiguous metal enclosure on all four sides.

In the prior art the shielded signal density tends to be limited by the need for adjacent ground pins or the mechanical construction of each connector module. This is also true when the mating halves of the connectors are joined. Thus, the signal density (i.e., the number of signal pins divided by the total number of signal and ground pins) in a five-row connector with the extreme outside pins and middle pin forming a ground shield for the signal contacts, there are only two signal remaining signal contact pins. Furthermore, there is limited contact shielding in the connector module. In the prior art, each individual contact does not have a metal enclosure. Rather, the entire connector module contains a plurality of contacts and metal plates covering three sides of the outside housing. The extruded connector housing module 11 provides channels 12 through 12*d* that enclose each of the example of individual metal contacts 13 through 13*d* in a contiguous metal shield 11 along the length of each contact.

The method of producing an extruded metallic electrical connector assembly 30 according to the present invention comprises the steps of extruding a continuous metal housing having a plurality of channels 32 positioned therein; cutting said housing to the desired length 32; coating the inside of said channels of said metal housing with an insulation material 33; installing the mating guides 34; installing the printed circuit board into said housing 35; terminating cable to the printed circuit board assembly 36; and electrically connecting (e.g., by welding) the assembly to the housing 37, thereby forming a cable assembly 40.

Electrical-optical Hybrid Connector

Figure 11:
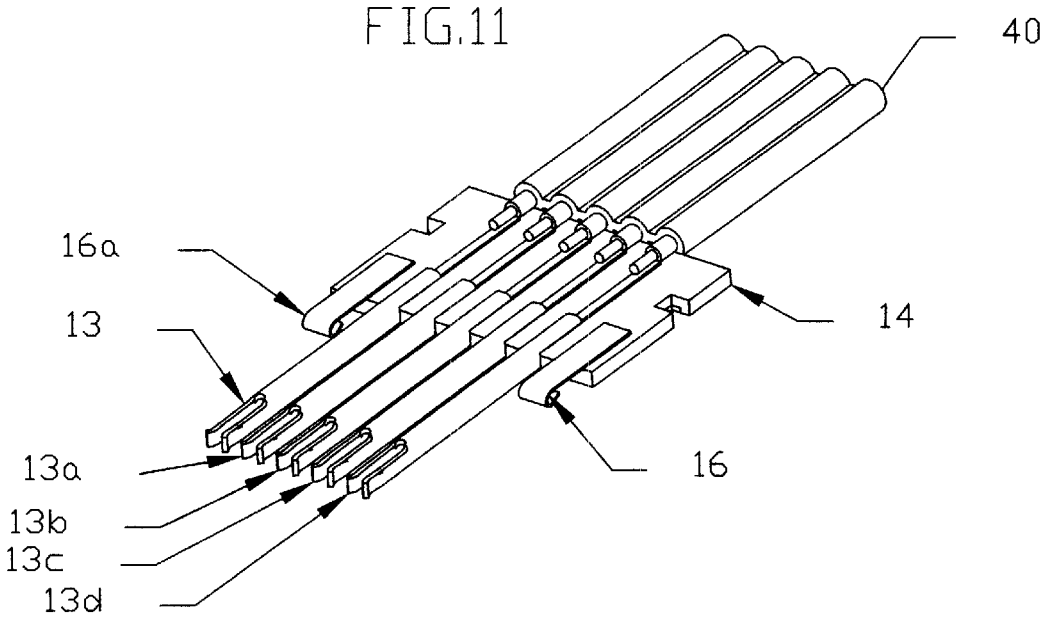
FIG. 11 is a perspective view showing the intermediate printed circuit board and contact point assembly.
Figure 10:
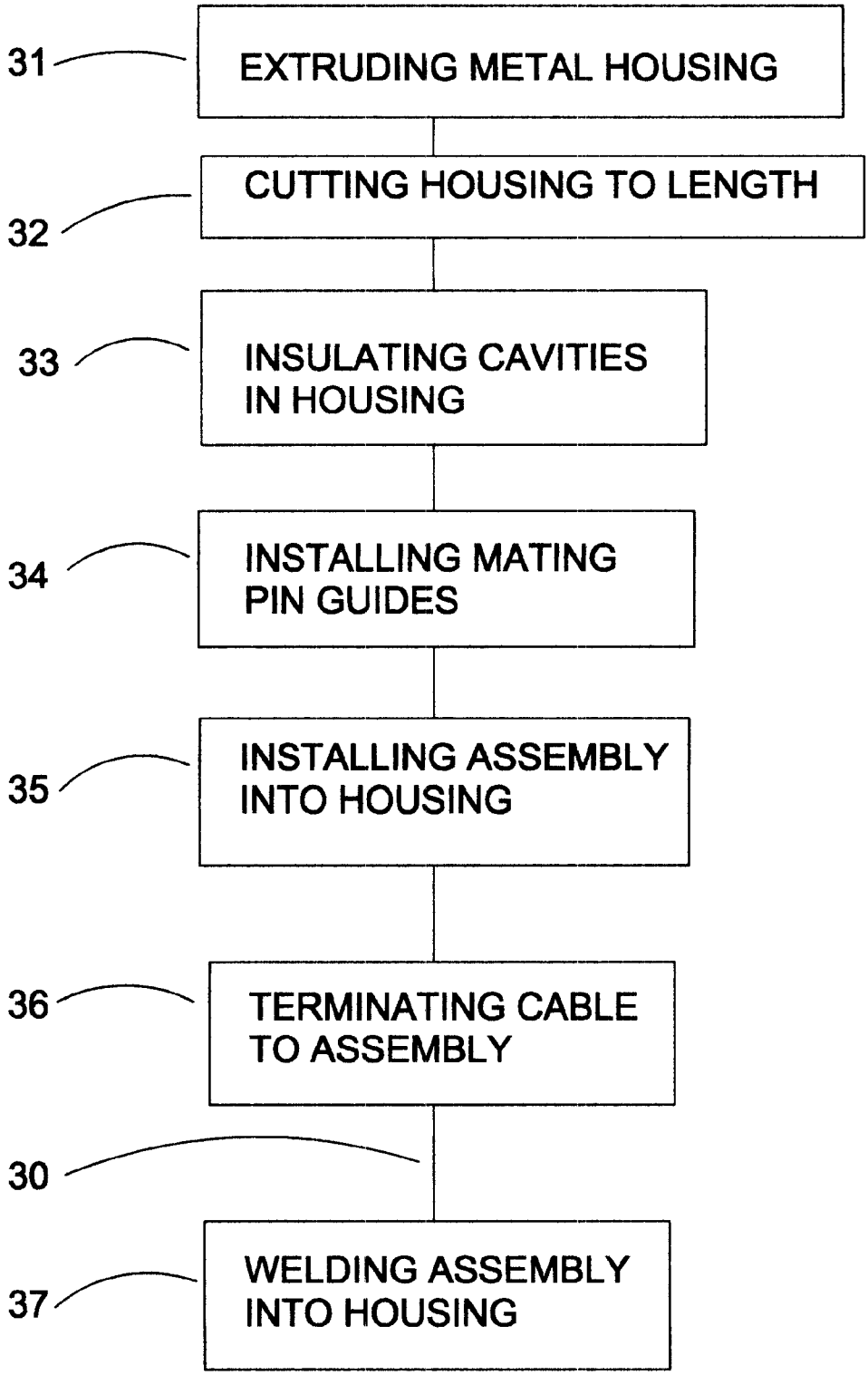
FIG. 10 is a block diagram of the novel method of producing an extruded metallic electrical connector assembly.

The present invention also includes a novel hybrid concept of using the extruded metal housing 37 (FIGS. 1, and 11) to facilitate both optical and electrical signal transmission. This is accomplished by making the connector have a hybrid configuration that permits the output of the connector at the intermediate printed circuit board to be a mix of optical and electrical transmission.

Figure 12:
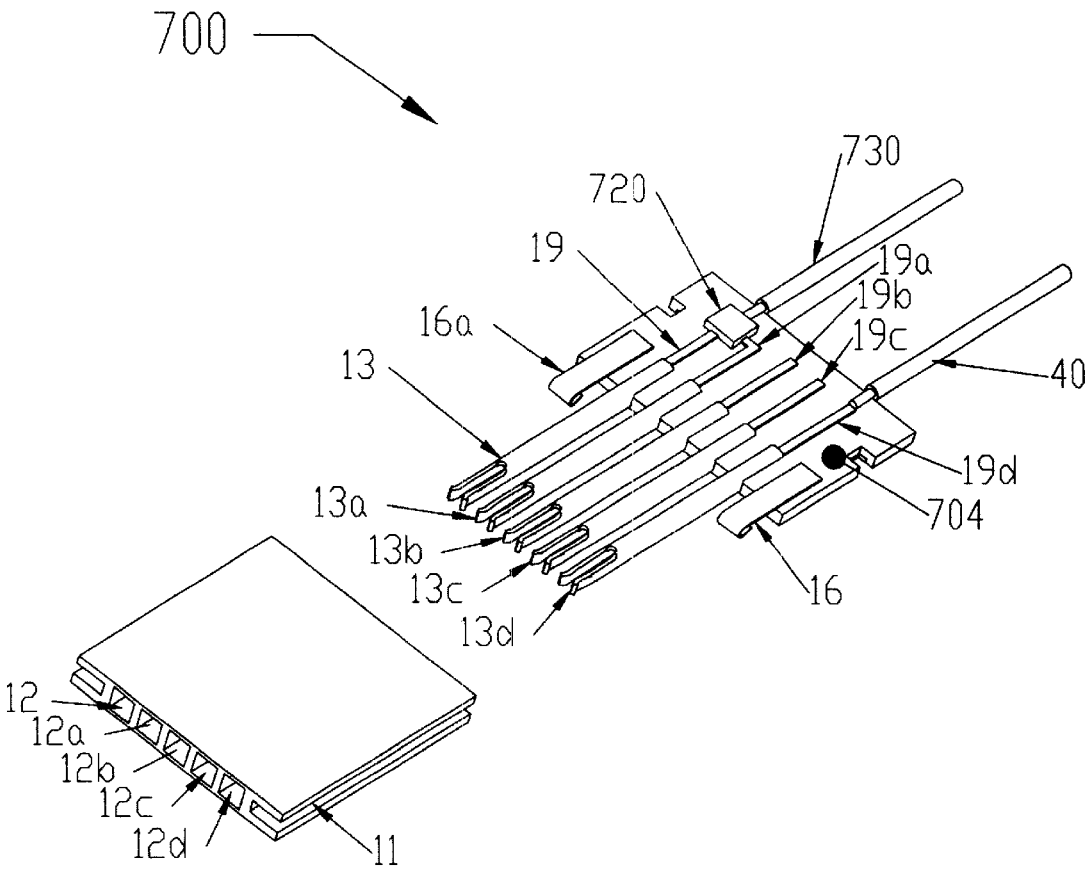
FIG. 12 is a perspective exploded view of the hybrid electrical-optical connector of the present invention similar to FIG. 11, but further including optical fibers and VCSELs attached to the intermediate printed circuit board.

Accordingly, with reference now to FIG. 12, there is shown the hybrid connector assembly 700 of the present invention. Hybrid connector 700 includes extruded metal connector housing 11, with channels 12–12*d* formed therein during extrusion, as described above. Connector 700 also includes IPCB 14 with a planar surface 704, which includes electrical contact pins 13–13*d*, and connector tension points 16 and 16*a* coupled to one end of the IPCB, also as described above. IPCB 14 also includes solder tails 19 (e.g., printed circuit board LAN), also described above, that connect contact pins 13–13*d* to one of either electrical cable (wire) 40 or one or more vertical cavity surface emitting lasers (VCSELs) 720 arranged on planar surface 704.

As is known in the art, a VCSEL is a device that takes a modulated electrical signal and converts it to a correspondingly modulated optical (laser) signal, or vice versa. Suitable VCSELs for the present invention are available, for example as part numbers ic-jwb 2.7 and ic-wk (laser-diode drivers) from IC Haus Corp., Sanford, Mich. (info@laserdriver.com), or from the Optical Interconnect Development Association, Washington, D.C., (Rockwell Science Center) model rsc110 (laser driver 2.5–10 Gbps), or from W. L. Gore, Wilmington, Del. (VCSEL laser driver). Information about VCSELs can be found at http://www.phy.hw.ac.uk/resrcv/review/vcsel-1.htm, or http://www.ieee.ca/supercan/ab34.html (the latter site includes a paper entitled "design of 2.5 Gbit/s GaAs laser driver with integrated APC for optical fiber communications," by Guillaume Fortin and Bozena Kaminska).

With continuing reference to FIG. 12, each VCSEL 720 receives a positive voltage and ground provided through dedicated contact pins (e.g. one of contact pins 13–13*d* and one of connection tension points 16) through conductive housing 11. One or more optical fibers (e.g., fiber cables) 730 are connected to IPCB 14 so as to be optically coupled to corresponding VCSELs 720, analogous to electrical wires

40 being electrically coupled to corresponding solder tails 19–19*d*. Optical fibers 730 may be single mode or multiple-mode, depending on the application.

In one mode of operation, an electrical signal enters assembly 700 through, say, pin 13*a* as shown. The electrical signal then travels through the associated solder tail 19*a* and into the corresponding VCSEL 720. The VCSEL converts the electrical signal into a corresponding optical signal, which is then passed to optical fiber 730. Assembly 700 can be used to go from optical to electrical signals (i.e., from driver to receiver) by reversing the VCSEL to operate as a laser receiver. Thus, hybrid connector assembly 700 allows for connection of both electrical and optical high-speed digital signals in a parallel configuration.

Figure 13:
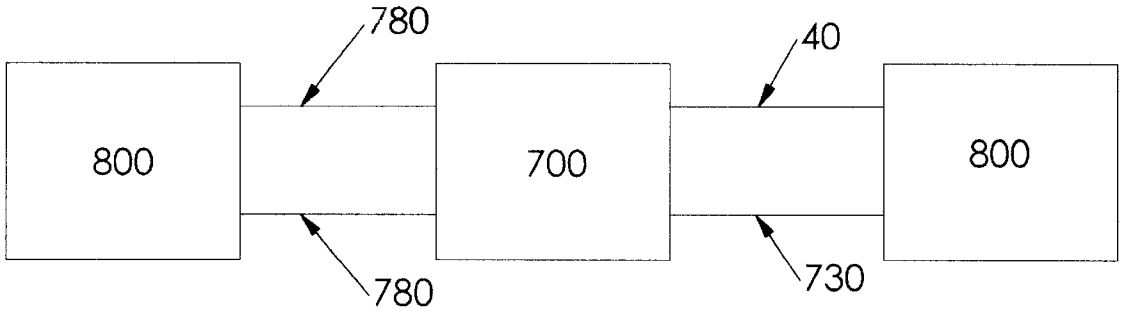
FIG. 13 is a schematic diagram of the hybrid connector of the present invention as shown in FIG. 12 as used to connect two remote circuits.

With reference to FIG. 13, an advantage of assembly 700 is connecting to different remote circuits 800 (e.g., back planes, mother boards, distribution panels, etc.) through assembly 700 with both optical fibers 730 and electrical wires 40 to one remote circuit, while electrically connecting to another remote circuit via one of a number of electrical connections 782 (e.g., vias on printed circuit boards, wires, etc.).

In a preferred embodiment of the present invention as illustrated in FIG. 13, the longer interconnections to remote circuit 780 can be accommodated by optical fiber (thereby ensuring signal integrity), while the shorter interconnections can be accommodated by more cost-effective electrical cable while still ensuring signal integrity. Thus, both electrical and optical high-speed connections can be provided in the single connector of the present invention.

The many features and advantages of the present invention are apparent from the detailed specification, and, thus, it is intended by the appended claims to cover all such features and advantages of the described apparatus that follow the true spirit and scope of the invention. Furthermore, since numerous modifications and changes will readily occur to those of skill in the art, it is not desired to limit the invention to the exact construction and operation described herein. Accordingly, other embodiments are within the scope of the appended claims.

What is claimed is:

1. A hybrid electrical-optical connector apparatus, comprising:

a metallic extruded housing having a plurality of channels formed therein during extrusion and having an insulating coating formed on the inside of the channels;

an intermediate printed circuit board having an upper planar surface with a plurality of solder tails formed thereon, and a corresponding plurality of electrical contact pins connected to respective solder tails and spaced apart so as to be capable of mating with said plurality of channels;

one or more vertical cavity surface emitting lasers (VCSELs) mounted to the upper planar surface so as to be in electrical communication with corresponding solder tails;

one or more optical fibers connected to the intermediate printed circuit board and arranged so that each optical fiber cable is in optical communication with a corresponding one of the one or more VCSELs.

2. An apparatus according to claim 1, further including one or more electrical wires connected to respective available solder tails.

3. An apparatus according to claim 1, wherein the one or more VCSELs are arranged to receive an electrical signal and convert the electrical signal to an optical signal.

4. An apparatus according to claim 1, wherein the one or more VCSELs are arranged to receive an optical signal and convert the optical signal to an electrical signal.

5. An apparatus according to claim 1, wherein each VCSEL receives a positive voltage provided through at least one of the contact pins and the conductive housing, and is grounded through a connection tension points and the conductive housing.

6. A system for connecting two remote circuits, comprising the hybrid electrical-optical connector of claim 1;

a first remote circuit electrically connected to the hybrid electrical-optical connector;

a second remote circuit electrically and optically connected to the hybrid electrical-optical connector.

7. A system according to claim 6, wherein the first and second remote circuits are at least one of a back plane, a mother boards, and a distribution panel.

8. A method of connecting remote circuits, comprising:

proving the hybrid electrical-optical assembly of claim 1;

electrically connecting a first remote circuit to one or more of the contact pins of the hybrid electrical-optical assembly; and optically connecting a second remote circuit to one or more of the one or more VCSELs.

9. A method according to claim 8, wherein the step of electrically connecting the first remote circuit includes transmitting a high-speed digital electrical signal.

10. A method according to claim 8, wherein electrically connecting the first remote circuit involves providing an electrical wire between the first remote circuit and to the one or more contact pins.

11. A method according to claim 10, wherein the electrical wire is part of an electrical cable.

12. A method according to claim 8, wherein the step of optically connecting involves providing an optical fiber optically coupled to the second remote circuit and to the one or more VCSELs.

13. A method according to claim 12, wherein the optical fiber is part of an optical fiber cable.

14. A hybrid electrical-optical connector apparatus, comprising:

a metallic extruded housing having a plurality of channels formed therein during extrusion, with each channel having a shared wall with another of the channels, and having an insulating coating formed on the inside of the channels;

an intermediate printed circuit board having an upper planar surface with a plurality of solder tails formed thereon, and a corresponding plurality of electrical contact pins connected to respective solder tails and spaced apart so as to be capable of mating with said plurality of channels;

one or more vertical cavity surface emitting lasers (VCSELs) mounted to the upper planar surface so as to be in electrical communication with corresponding solder tails;

one or more optical fibers connected to the intermediate printed circuit board and arranged so that each optical fiber cable is in optical communication with a corresponding one of the one or more VCSELs.

* * * * *